US007270781B2

(12) United States Patent
Yamamoto et al.

(10) Patent No.: US 7,270,781 B2
(45) Date of Patent: Sep. 18, 2007

(54) SYSTEM FOR PRODUCING ALLOY CONTAINING RARE EARTH METAL

(75) Inventors: Kazuhiko Yamamoto, Kobe (JP); Takayuki Shibamoto, Ono (JP)

(73) Assignee: Santoku Corporation, Hyogo, Kobe-Shi (JP)

( * ) Notice: Subject to any disclaimer, the term of this patent is extended or adjusted under 35 U.S.C. 154(b) by 469 days.

(21) Appl. No.: 10/516,520

(22) PCT Filed: May 29, 2003

(86) PCT No.: PCT/JP03/06740

§ 371 (c)(1),
(2), (4) Date: Dec. 29, 2004

(87) PCT Pub. No.: WO03/100103

PCT Pub. Date: Dec. 4, 2003

(65) Prior Publication Data

US 2006/0076719 A1 Apr. 13, 2006

(30) Foreign Application Priority Data

May 29, 2002 (JP) ..... 2002-155121

(51) Int. Cl.
*C21D 1/62* (2006.01)

(52) U.S. Cl. ..... 266/259; 266/241; 266/217

(58) Field of Classification Search ..... 266/207, 266/212, 217, 241, 259
See application file for complete search history.

(56) References Cited

U.S. PATENT DOCUMENTS

| | | | | |
|---|---|---|---|---|
| 5,908,513 | A | 6/1999 | Sasaki et al. | |
| 5,963,774 | A | 10/1999 | Sasaki et al. | |
| 6,403,024 | B1 * | 6/2002 | Oota et al. | 419/33 |
| 6,797,081 | B2 * | 9/2004 | Hasegawa et al. | 148/539 |

FOREIGN PATENT DOCUMENTS

| | | |
|---|---|---|
| EP | 0 514 325 A2 | 11/1992 |
| JP | 09-155507 | 6/1998 |
| JP | 2000-161859 | 6/2000 |

* cited by examiner

*Primary Examiner*—Len Tran
(74) *Attorney, Agent, or Firm*—Darby & Darby

(57) ABSTRACT

The present invention is a manufacturing system for alloys containing rare earth metals which presents oxidation of alloy during production, facilitates thermal history control of the alloy, and efficiently produces alloys of a uniform structure. The manufacturing system includes a melting furnace for melting a starting material alloy, solidifying means for continuously solidifying an alloy melt into alloy flakes, crystal structure controlling means for controlling the alloy crystal structure, and cooling means for cooling the alloy flakes. These components are operable in an inert gas atmosphere. The crystal structure controlling means includes a conveying device having a delivery space for continuously delivering the alloy flakes from the solidifying means to the cooling means, for the conveying device has temperature regulating means for regulating the temperature of the delivery.

10 Claims, 6 Drawing Sheets

SYSTEM FOR PRODUCING ALLOY CONTAINING RARE EARTH METAL

FIELD OF ART

The present invention relates to a manufacturing system for alloys containing rare earth metals that may be used as magnet materials, hydrogen storage alloys, and anode materials for rechargeable batteries.

BACKGROUND ART

Alloys containing rare earth metals that may be used as magnet materials, hydrogen storage alloys, and anode materials for rechargeable batteries are conventionally known to be produced in a system wherein an alloy melt, a starting material, is cooled on a rotating roll into alloy thin ribbons or thin flakes (sometimes referred to collectively as alloy flakes hereinbelow). Such alloy flakes are pulverized and used in various applications.

The manufacturing system of this type is usually configured to enable a series of steps from feeding the alloy melt onto the rotating roll, cooling and solidifying, through separating the alloy from the rotating roll to be performed in an inert gas atmosphere, in order to prevent oxidation of alloys during the production process. The alloy flakes immediately after they are cooled on and separating from the rotating roll, have not been cooled down to the room temperature, but are still at a temperature of as high as several hundred degrees centigrade. Such hot alloy flakes are instantly oxidized upon exposure to the atmosphere, and may even ignite. Thus the hot alloy flakes are placed in an airtight container in an inert gas atmosphere, and kept for usually about 24 hours until the temperature falls to the room temperature, or rapidly cooled by, for example, gas-cooling to the room temperature (JP-3201944-B).

In the fields of industry wherein alloys containing rare earth metals are utilized, the final products have been demanded to have higher performance to keep up with the rapid development in electronics or the like. This in turn creates demand for development of alloys containing rare earth metals with higher performance. Such improvement in alloy performance is achieved in particular by controlling the crystal structure of the alloys.

The crystal structure of an alloy generally depends on the thermal history of the alloy flakes during the production process. Control of the alloy crystal structure is achieved by forced-cooling the as-cast alloy flakes rapidly to the room temperature, and subsequently heat-treating the flakes in a heat treatment furnace under particular conditions. Alternatively, particularly in the field of magnet materials, an attempt is made to control the alloy crystal structure by controlling the temperature for melting the starting material, the primary cooling rate on the rotating roll, and the secondary cooling rate after the alloy flakes are separated from the rotating roll. The control of the secondary cooling rate is made by collecting the alloy flakes separated from the rotating roll in a container made of a heat insulating material, and keeping the alloy flakes in the container for a particular period of time (see, for example, JP-8-269643-A, JP-3267133-B, JP-10-36949-A, and JP-2002-266006-A).

Controlling the thermal history of alloy flakes by means of the container made of a heat insulating material has disadvantages in that the thermal history cannot be uniform over the alloy flakes. This is because many of the alloy flakes solidified right after the casting is started are brought into direct contact with the container to conduct heat, and as the casting proceeds, the alloy flakes subsequently formed are built up in the container to conduct heat between the alloy flakes in contact with one another. When, in particular, as much as several hundred kilograms or more of alloy is cast in an industrial scale, it takes a few minutes to a several tens of minutes from the start to the end of the casting, but the alloy flakes are collected from the container all at once. This causes wide difference between the flakes at the bottom and the top of the container in their retention time in the container, and a diversity of thermal history is given to the alloy flakes of the same production lot. Thus a large percentage of the alloy flakes are not given the intended crystal structure. Further, collection of the alloy flakes in a container made of a heat insulating material may slow down the cooling rate of the alloy flakes, but cannot achieve precise control of the cooling rate, raise the temperature of the alloy flakes, or maintain the temperature of the flakes at a particular level.

SUMMARY OF THE INVENTION

It is an object of the present invention to provide a manufacturing system for alloys containing rare earth metals which prevents oxidation of the alloy during production, facilitates and improves the efficiency of thermal history control of the alloy performed for obtaining a desired crystal structure, and reduces fluctuation in thermal history of the alloy in the same production lot.

According to the present invention, there is provided a manufacturing system for an alloy material containing rare earth metals comprising:

a melting furnace for melting a starting material alloy containing rare earth metals, solidifying means for continuously cooling and solidifying an alloy melt discharged from the melting furnace into alloy flakes, crystal structure controlling means for controlling a crystal structure of the alloy flakes into a desired state, and cooling means for cooling the alloy flakes, wherein at least said melting furnace, said solidifying means, said crystal structure controlling means, and said cooling means are operable in an inert gas atmosphere, said crystal structure controlling means further comprising a conveying device having a delivery space for continuously delivering the alloy flakes from the solidifying means to the cooling means, said conveying device having temperature regulating means for regulating the temperature of said delivery space to a desired temperature.

PREFERRED EMBODIMENT OF THE INVENTION

Figure 1:
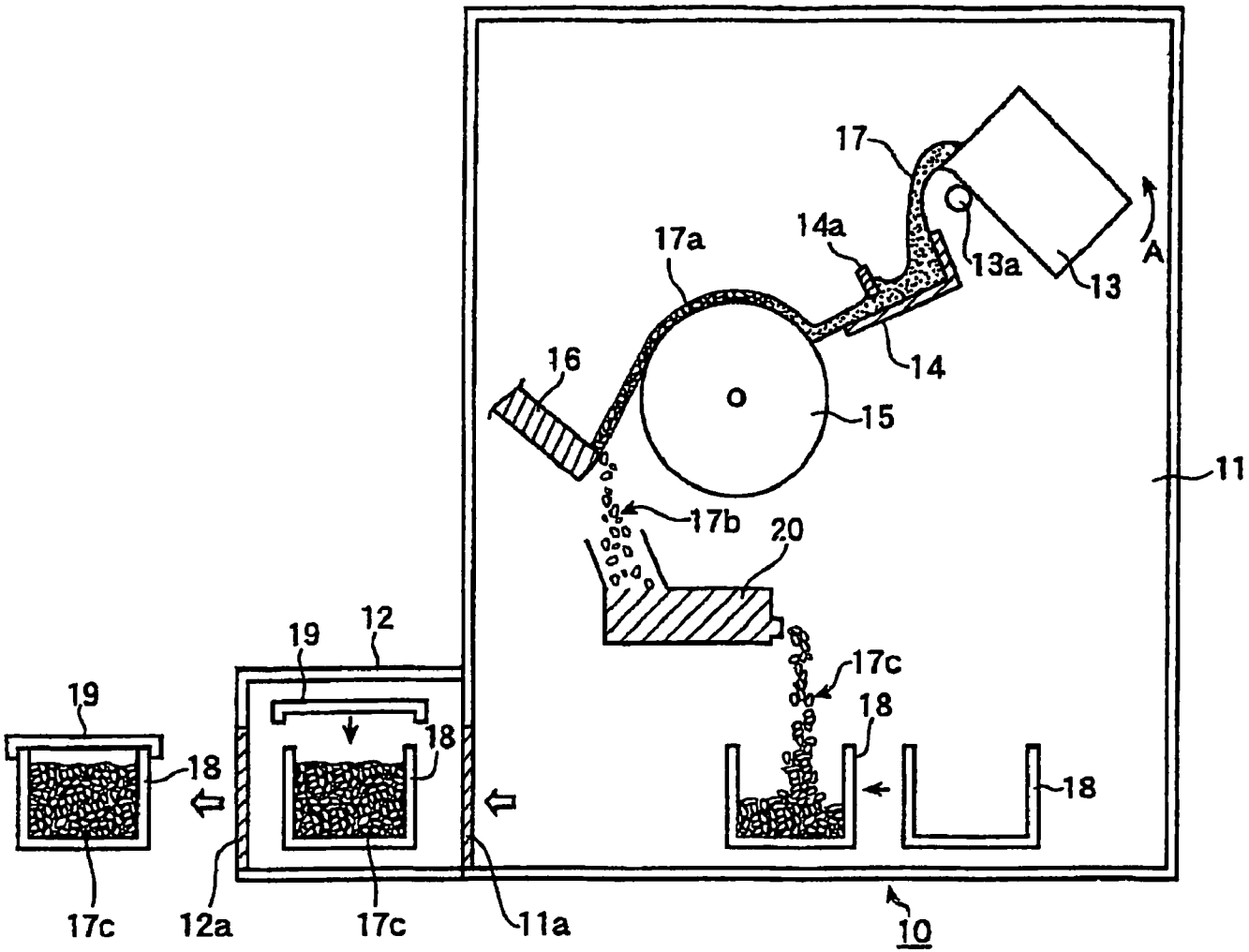
FIG. 1 is a schematic view of an example of the manufacturing system according to the present invention.

The present invention will now be explained in detail.

The manufacturing system according to the present invention has a melting furnace, solidifying means, crystal structure controlling means, and cooling means, and at least these components are capable of being held in an inert gas atmosphere.

The melting furnace may be a furnace having an ordinary heating vessel such as a crucible, equipped with tilting means for tilting the heating vessel around a particular axis to discharge the alloy melt contained therein. The melting furnace is preferably capable of discharging the alloy melt at a constant flow rate.

The solidifying means is capable of continuously solidifying the alloy melt into thin ribbons or thin flakes, and may be a cooling and solidifying device including, for example, a roll-type cooling and solidifying device having twin rolls, a single roll, or the like, a disk-type cooling and solidifying device having a rotating disk or the like, or other conventional cooling and solidifying device.

The solidifying means preferably has a tundish. The tundish may be an ordinary tundish having a bottom for allowing flow of the alloy melt from the melting furnace, and side walls for preventing flow of the alloy melt over the sides of the bottom. Alternatively, the tundish may have a structure for allowing a temporary pool of the alloy melt from the melting furnace to slow down its flow rate, and feeding the alloy melt at a substantially constant flow rate to the cooling and solidifying device. The tundish of this type may be a tundish provided on its bottom with a weir plate having a plurality of paths for passing the alloy melt.

The solidifying means may optionally have a crushing section for crushing the solidified product obtained from the cooling and solidifying device. The crushing section may be of any type as long as it can crush the solidified product into thin flakes of about 1 cm×1 cm in size, and may be, for example, an impact crusher plate utilizing the discharge velocity of the solidified product from the cooling and solidifying apparatus, or a feather mill.

The impact crusher plate may be disposed at a position to allow the solidified product cooled in the cooling and solidifying device to crash into the plate as it is discharged. This impact crusher plate may be any hard, plate-like member formed of a metal plate, ceramics structure, or the like.

The crystal structure controlling means for controlling the alloy crystal structure is capable of continuously conveying the alloy flakes discharged from the solidifying means to the cooling means, which will be discussed later, and at the same time, controlling the thermal history of the alloy flakes being conveyed. The crystal structure controlling means is provided with a conveying device having a delivery space for conveying the alloy flakes. The conveying device may be of any type as long as the device has temperature regulating means for regulating the temperature of the delivery space to a desired temperature, in order to enable slow down, maintenance, or raise of the temperature of the alloy flakes, or combination of these controls. The thermal history of the alloy flakes may be controlled by controlling the temperature of the delivery space and the conveying speed.

The conveying device may be a device having a rotatable pipe (A) which is provided with a fin extending spirally along its inner surface at a particular angle, and defines the delivery space therein. The pipe (A) is provided with at least one of a heat insulating layer and a heating section, as the temperature regulating means mentioned above. Specifically, the conveying device may have an electric furnace with an external heating unit, such as of a rotary kiln type, wherein the alloy flakes are introduced into the pipe, and the pipe is rotated to convey the alloy flakes at a particular rate.

The conveying device may be composed of connected pipes consisting of a plurality of pipes (A) connected with each other, with each pipe (A) being provided with the temperature regulating means for controlling the temperature of each pipe (A) independently from others, or a multiple pipe consisting of a plurality of pipes (A) arranged coaxially, with each pipe (A) being provided with the temperature regulating means for controlling the temperature of each pipe (A) independently from others. With such devices, the temperature of each pipe (A) may be regulated to establish different conditions for each pipe. When the multiple pipe is used, a compact device may result.

The conveying device may also be a device of a tunnel kiln type, wherein the temperature inside the tunnel may be controlled as desired. With this device of a tunnel kiln type, the alloy flakes may be conveyed by means of a belt conveyor or a vibrating plate arranged through the tunnel. In order to achieve uniform temperature regulation over the tunnel kiln, it is preferred to provide a guide or the like at the entrance for controlling the feed rate of the alloy flakes, so that the alloy flakes are fed into the tunnel at approximately a constant rate.

The cooling means may be any cooling device that is capable of containing the alloy flakes with controlled thermal history received from the crystal structure controlling means, and cooling the alloy flakes to a room temperature in an inert gas atmosphere. In the light of production efficiency, a cooling device is preferred which can cool the alloy flakes to a room temperature by means of a cooling medium, such as water or coolant gas, in a relatively short time, usually in 1 hour, preferably in 30 minutes.

The cooling means may be, for example, a cylindrical cooling device in the form of a rotatable pipe provided with a cooling unit for circulating a cooling medium in the pipe wall or outside the pipe wall. It is preferred that the cylindrical cooling device is provided on its inner surface with multiple fins extending from one end toward the other end of the pipe in the direction generally horizontal to the rotation axis so that the alloy flakes are mixed and brought into uniform contact with the inner surface of the pipe.

The cylindrical cooling device may be arranged coaxially around the multiple pipe of the crystal structure controlling means to integrate the crystal structure controlling means and the cooling means, thereby downsizing the manufacturing system. Further, the cylindrical cooling device may be structured so that the device is kept in a horizontal position during cooling operation, and after the cooling operation is finished, the rotation axis is tilted to some extent for discharging the alloy flakes.

The cooling means may alternatively be a cooling device in the form of a container for containing the alloy flakes discharged from the crystal structure controlling means. This cooling device in the form of a container may have a container for containing the alloy flakes discharged from the crystal structure controlling means, and a cooling medium feed unit for circulating a cooling medium through the hollow structure of the walls of the container.

The cooling means is not limited to the above mentioned cooling devices; but may be a device for cooling the alloy flakes by directly feeding a cooling gas (inert gas) to the flakes, or a device for natural cooling without a forced cooling means.

Since the manufacturing system of the present invention includes the cooling means for cooling the alloy flakes to a room temperature, the alloy flakes may be packed continuously in small portions before they leave the manufacturing system, which is efficient. Further, the alloy flakes leaving the manufacturing system may be transferred to the subsequent pulverizing step, if any, without excessive oxidation.

It suffices that the manufacturing system of the present invention includes at least the melting furnace, the solidifying means, the crystal structure controlling means, and the cooling means, and that these components are capable of being held in an inert gas atmosphere. For example, all of these components may be arranged in one chamber that can be held in an inert gas atmosphere, or each component may be arranged in a separate chamber that can be held in an inert gas atmosphere. Such chamber may be of any type as long as it is airtight for keeping inside an inert gas atmosphere, and is equipped with a unit for introducing/discharging an inert gas. The chamber may preferably be provided with a conventional pressure reducing device for reducing the pressure inside the chamber.

In addition to the above-mentioned chambers, the manufacturing system of the present invention may optionally be provided with an additional chamber next to the exit for discharging the alloy flakes treated in the cooling means out of the system. This additional chamber may have communicating/blocking means for opening/closing the exit mentioned above, and apparatus for keeping the interior of the additional chamber in an inert gas atmosphere and at a reduced pressure.

The additional chamber allows the produced alloy flakes to be discharged from the manufacturing system of the invention without allowing entry of the atmospheric air into the system.

With the manufacturing system of the present invention, an alloy material containing rare earth metals may be produced, for example, as follows.

First, a starting material alloy containing rare earth metals is melted in the melting furnace. The starting material alloy containing rare earth metals may suitably be selected for intended use in view of the conventionally known compositions. The starting material alloy may either be a mixture of various metals or a master alloy. The conditions for melting may suitably be selected depending on the alloy composition in view of the conventionally known conditions.

Next, the alloy melt discharged from the melting furnace is continuously cooled and solidified with the solidifying means into alloy flakes. For example, the alloy flakes may be prepared by solidifying the alloy melt into thin ribbons or thin flakes, and optionally pulverizing the solidified thin ribbons or thin flakes. The alloy melt may be solidified into thin ribbons or thin flakes by means of, for example, a roll-type cooling and solidifying device having twin rolls, a single roll, or the like, a disk-type cooling and solidifying device having a rotating disk or the like, or other conventional cooling and solidifying device. In order to prepare alloy flakes of a uniform thickness, the cooling and solidifying device may be provided with a tundish or the like part for controlling the flow of the alloy melt.

The conditions for cooling with the cooling and solidifying device may suitably be selected depending on the objective alloy containing rare earth metals, taking the conventionally known conditions into account. The cooling rate may usually be about 100 to 10000° C./sec.

The alloy flakes may be crushed, for example, by disposing at a desired position a plate-like member having an alloy crash surface, into which the solidified alloy separated from the roll-type cooling and solidifying device is crashed as it is discharged.

The alloy flakes obtained from the cooling and solidifying device have a surface temperature of usually not lower than 700° C., preferably not lower than 800° C. The temperature of the alloy flakes may be measured with a non-contact type thermometer, such as an optical thermometer or an infrared thermometer.

Next, the alloy flakes are continuously conveyed under regulated temperature for controlling the thermal history to give a desired alloy crystal structure. The thermal history of the alloy flakes is controlled preferably before the surface temperature of the alloy flakes discharged from the solidifying means is lowered usually to 400° C. or lower, preferably to 500° C. or lower. If the surface temperature of the alloy flakes is lowered to 100° C. or lower before the control of the alloy crystal structure, a considerable amount of energy required for the control is wasted. The control of the alloy crystal structure may include control of the crystal grain size, the ratio of crystal phases, and the shape of precipitated crystals. The temperature and duration of the control vary widely depending on the alloy composition, the thickness of the alloy flakes, the objective crystal structure, and the like factors. The control may be carried out in the temperature range of 400 to 800° C. in a short time, such as for about 1 second to 1 hour, preferably for about 2 seconds to 30 minutes, more preferably for about 5 seconds to 20 minutes.

Next, the alloy flakes are cooled. The cooling may result in the alloy flake temperature of not higher than 200° C., preferably not higher than 100° C., more preferably to approximately a room temperature. Such cooling may be forced cooling with a cooling medium, or natural cooling.

Compared to the conventional method wherein the alloy flakes are subjected to a thermal treatment after they are forced-cooled to approximately a room temperature, the manufacturing system of the present invention allows reduction of energy required for controlling the alloy crystal structure, and continuous production of alloy flakes of a uniform crystal structure from an alloy melt. Surprisingly, the alloy crystals may be made uniform in an extremely short time.

With the manufacturing system of the present invention, all the steps including melting, solidifying, controlling of the alloy crystal structure, and cooling, are continuously performed in an inert gas atmosphere. Thus the alloy flakes cooled to approximately a room temperature may be obtained without exposing the alloy flakes to atmospheric air, which oxidizes the alloy flakes.

The manufacturing system of the present invention will now be explained with reference to embodiments taken in conjunction with the attached drawings, which are illustrative only and do not intend to limit the present system.

FIG. 1 is a schematic view for explaining the system for manufacturing an alloy containing rare earth metals according to the present invention, wherein the manufacturing system is designated by 10.

The manufacturing system 10 includes first chamber 11, which is airtight and may establish an inert gas atmosphere and a reduced pressure therein, and second chamber 12, which is optional.

The first chamber 11 accommodates melting furnace 13 for melting a starting material alloy containing rare earth metals; solidifying means including rotating roll 15 for cooling and solidifying alloy melt 17 discharged from the melting furnace 13 into thin ribbons, tundish 14 for guiding the alloy melt 17 from the melting furnace 13 onto the rotating roll 15, and alloy crushing plate 16 for crushing thin ribbons 17*a* of the alloy containing rare earth metals separated from the rotating roll 15 simply by allowing the alloy ribbons to crash into the plate 16 as they are separated from the roll; crystal structure controlling device 20 for giving broken alloy 17*b* a desired, uniform alloy crystal structure; and cooling device 18 in the form of a container for containing and forced-cooling alloy 17*c* discharged from the device 20. The chamber 11 has shutter 11*a* that may be opened or closed for keeping the chamber airtight, at a location where the chamber 11 is communicated with the second chamber 12.

The melting furnace 13 is capable of tilting around axis 13*a* in the direction of arrow A after the starting material alloy containing rare earth metals is melted, so that the alloy melt 17 is poured into the tundish 14 at a substantially constant rate.

The tundish 14 is shown in section, with its side walls for preventing flow of the alloy melt 17 over the sides thereof being omitted, and has weir plate 14*a* for rectifying the flow of the alloy melt 17 discharged from the melting furnace 13 to feed the melt onto the rotating roll 15 at substantially a constant rate.

The rotating roll 15 has the outer circumferential surface made of a material capable of cooling the alloy melt 17, such as copper, and is equipped with a drive unit (not shown) for rotating the roll at a constant angular velocity.

The alloy crushing plate 16 is a plate-like member made of metal and is disposed at a position for allowing the alloy 17*a* separated from the rotating roll 15 to continuously crash into the plate.

The alloy 17*b* broken on the alloy crushing plate 16 usually has a surface temperature of not lower than 700° C., which may, though, vary depending on the alloy composition, the cooling rate, or the like factors. The device 20 should be arranged at a position for not allowing the surface temperature to drop to 400° C. or lower.

Figure 2:
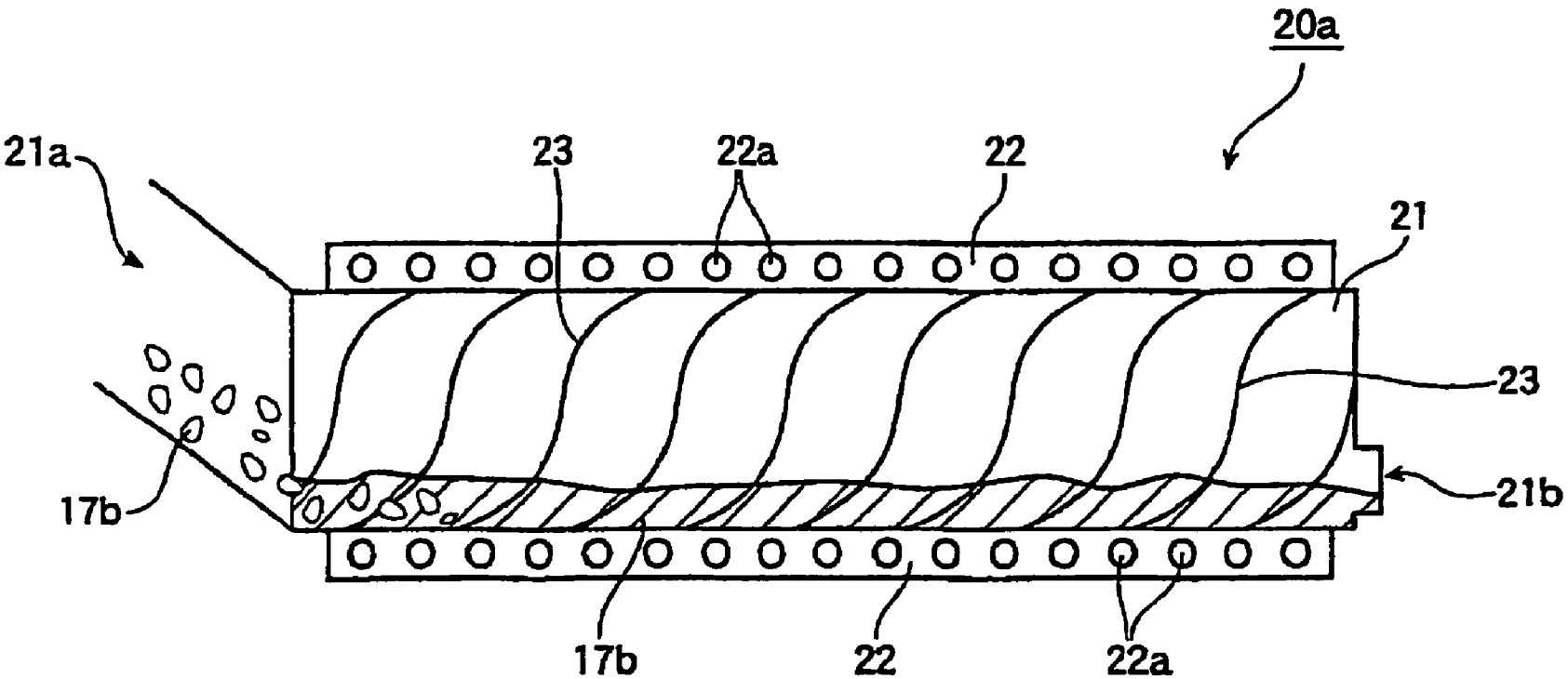
FIG. 2 is a schematic view of an example of the conveying device of a rotary kiln type used in the manufacturing system according to the present invention.

The device 20 may be crystal structure controlling device 20*a* for controlling the alloy crystal structure as shown in FIG. 2, which is of a rotary kiln type and capable of regulating temperature. The device 20*a* is composed of rotatable pipe 21, which defines a delivery space for the alloy 17*b* therein, and has entry port 21*a* for the alloy 17*b*, exit port 21*b* for discharging the alloy 17*c* of which crystal structure has been controlled, and heating section 22 provided with heating coil 22*a*. Along the inner surface of the pipe 21, fin 23 is provided for conveying the alloy 17*b* introduced into the pipe toward the exit port 21*b* as the pipe 21 rotates. By rotating the pipe 21 at a desired velocity, the alloy 17*b* may be conveyed toward the exit port 21*b* at a desired rate.

The temperature of the alloy 17*b* introduced into the device 20*a* is regulated to a particular level by suitable operation of the heating section 22. The thermal history of the alloy 17*b* may be controlled at the particular temperature for a particular period of time by adjusting the rotational velocity of the pipe 21, the angle of the fin 23, or the like. By subjecting the alloy 17*a* to the control at a particular temperature for a particular period of time in this way, the alloy 17*c* having a desired, uniform crystal structure may be produced efficiently in a short time.

Figure 3:
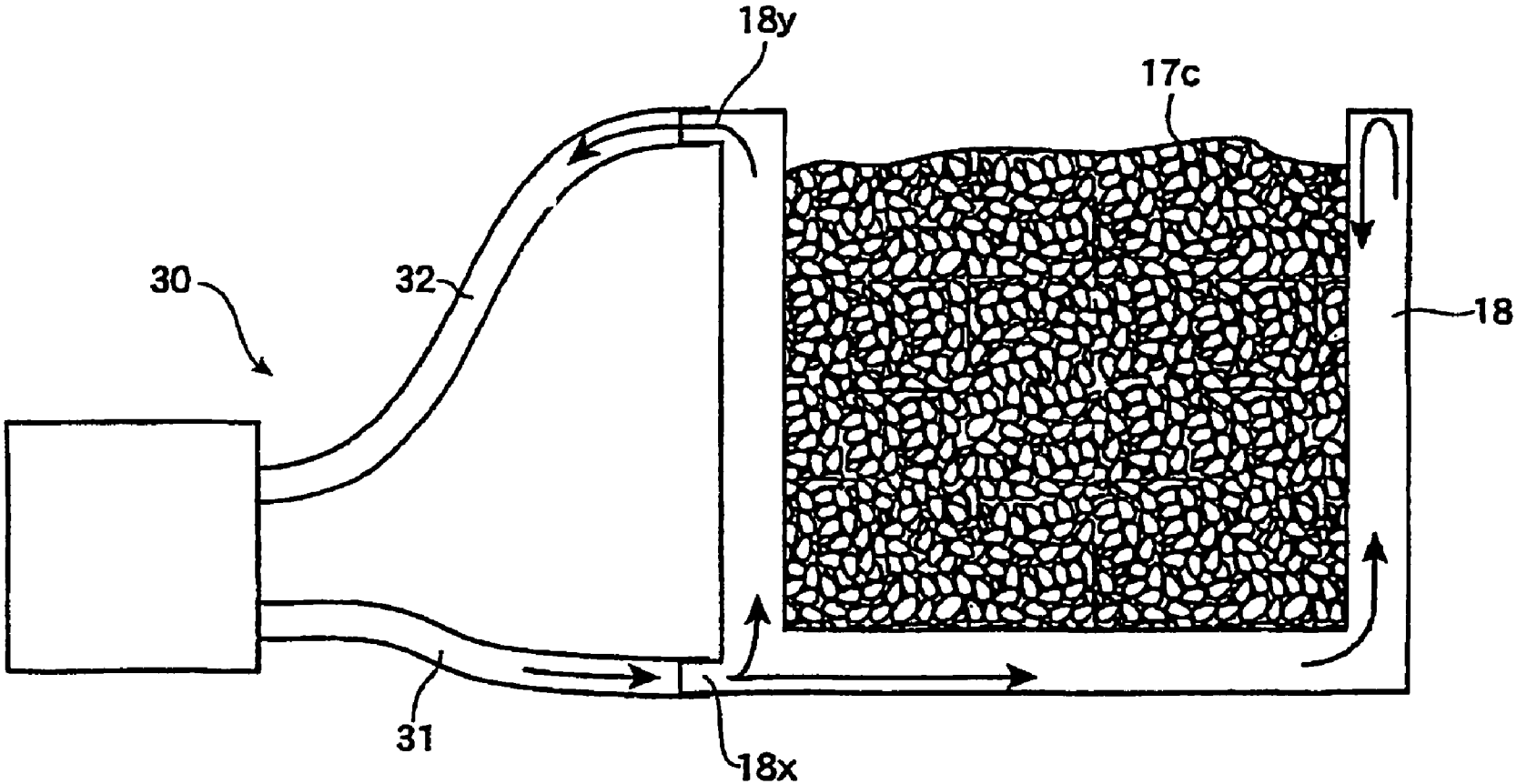
FIG. 3 is a schematic view of an example of the cooling device in the form of a container used in the manufacturing system according to the present invention.

Below the device 20 is arranged the cooling device 18 in the form of a container for containing and forced-cooling the alloy 17*c*. The cooling device 18 may have, for example as shown in FIG. 3, hollow walls with cooling medium inlet 18*x* and outlet 18*y*, for circulating a cooling medium through the hollow structure. The alloy 17*c* contained in the cooling device 18 in the form of a container may be cooled by connecting lines 31 and 32 of cooling unit 30 to the cooling medium inlet 18× and outlet 18*y*, respectively, and circulating a cooling medium, such as a coolant gas, through the hollow structure.

The alloy 17*c* cooled in the cooling device 18 in the form of a container, after the cooling unit 30 is detached from the cooling device 18, is transferred toward the shutter 11*a*, and another empty cooling device 18 in the form of a container is arranged below the device 20 for containing and cooling the alloy 17*c*.

The cooling device 18 in the form of a container with the cooled alloy 17*c* therein transferred toward the shutter 11*a* is then moved into the second chamber 12. The chamber 12 has shutter 12*a*, which may be opened and closed, and is provided with gas introducing/discharging lines and a pressure reducing device (not shown).

The cooling device 18 in the form of a container with the cooled alloy 17*c* therein may be moved into the chamber 12 by establishing an inert gas atmosphere in the chamber 12, opening the shutter 11*a* of the chamber 11, transferring the cooling device 18 in the form of a container into the chamber 12, and closing the shutter 11*a*. Then the chamber 12 is evacuated, the cooling device 18 in the form of a container is capped with lid 19 for sealing the device 18, the shutter 12*a* is opened, and the sealed cooling device 18 in the form of a container is transferred out of the chamber 12. By providing the chamber 12, all the manufacturing steps may be carried out with the chamber 11 being maintained in an inert gas atmosphere.

Figure 4:
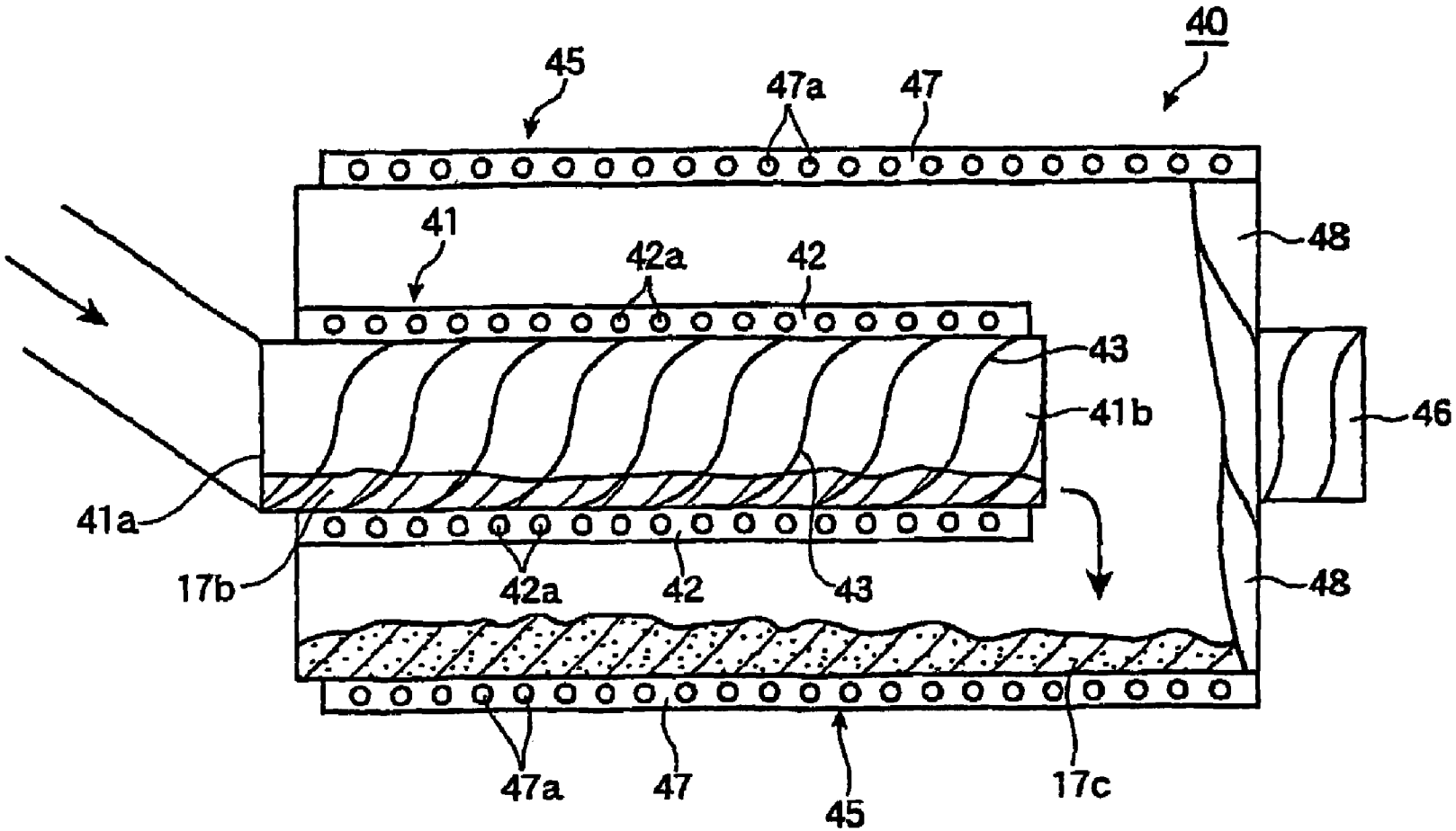
FIG. 4 is a schematic view of an example of apparatus having integrally arranged crystal structure cooling means and cooling means, used in the manufacturing system according to the present invention.
Figure 5:
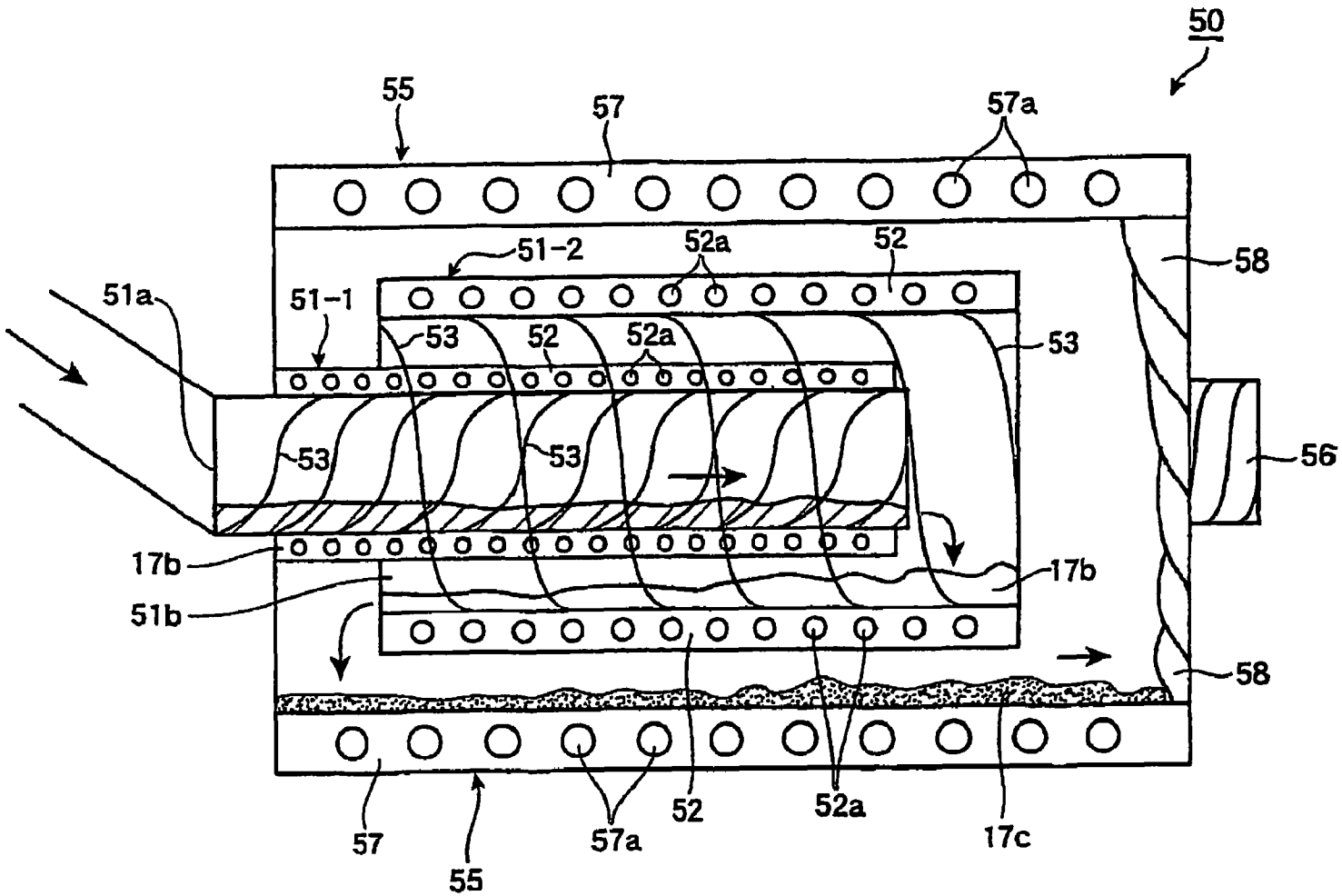
FIG. 5 is a schematic view of another example of apparatus having integrally arranged crystal structure controlling means and cooling means, used in the manufacturing system according to the present invention.

Referring to FIGS. 4 and 5, alternative embodiments of the manufacturing system are explained, wherein the crystal structure controlling device 20*a* shown in FIG. 2 is replaced with device 40 or 50 wherein the crystal structure controlling device and the cooling means are integrated.

The device 40 or 50 may be disposed at a location for not allowing the surface temperature of the alloy 17*b* broken on the alloy crushing plate 16 to drop beyond the particular temperature, as with the case with the device 20 shown in FIG. 1.

The device (40, 50) is composed of rotatable pipe(s) (41, 51-1, 51-2), which defines a delivery space therein for continuously conveying the alloy 17*b*, and has entry port (41*a*, 51*a*) for the alloy 17*b*, exit port (41*b*, 51*b*) for discharging the alloy 17*c* of which crystal structure has been controlled, and heating section (42, 52) provided with heating coil (42*a*, 52*a*). A cylindrical cooling device (45, 55) is provided coaxially around the pipe (41, 51-2). In other words, the device 40 has the single pipe 41, and the device 50 has the double pipe (51-1, 51-2), as the crystal structure controlling device for controlling the crystal structure of the alloy 17*b*. The device 50 with the double pipe (51-1, 51-2) may be employed for providing longer time for controlling the alloy crystal structure, or for reducing the space for installing the device.

Along the inner surface of the pipe (41, 51-1, 51-2), fin (43, 53) is provided so that the alloy 17*b* introduced into the pipe is conveyed toward the exit port (41*b*, 51*b*) as the pipe (41, 51-1, 51-2) rotates. Here, "the alloy 17*b* introduced into the pipe is conveyed toward the exit port 51*b*" means that the alloy 17*b* in the pipes (51-1, 51-2) is transferred in the direction of the arrows as the pipes rotate, and eventually conveyed toward the exit port 51*b*.

The temperature of the alloy 17*b* introduced into the pipe (41, 51-1, 51-2) is maintained at a particular level by suitable operation of the heating section (42, 52). The alloy 17*b* is subjected to the control at the particular temperature for a particular period of time by adjusting the rotational velocity of the pipe (41, 51-1, 51-2) and/or the angle of the fin (43, 53). By subjecting the alloy 17*a* to the control at a particular temperature for a particular period of time in this way, the alloy 17*c* having a desired, uniform crystal structure may be produced efficiently in a short time.

The cylindrical cooling device (45, 55) is composed of a rotatable pipe having exit port (46, 56) for discharging the alloy 17*c* with the controlled crystal structure, and cooling section (47, 57) provided with cooling medium circulation line (47*a*, 57*a*) for circulating a cooling medium. The cylindrical cooling device (45, 55) is structured so that the rotation axis is tilted with the exit-port-side down upon discharge of the forced-cooled alloy 17*c* through the exit port (46, 56). Further, fins (48, 58) are provided at the exit-port-side of the cylindrical cooling device (45, 55) for discharging the alloy 17*c* out of the pipe. These fins do not act on the alloy 17*c* during rotation of the pipe for cooling, but by rotating the pipe in a reverse direction with the rotation axis being tilted, the fins guide the alloy 17*c* toward the exit port (46, 56).

Along the inner surface of the cylindrical cooling device (45, 55), a fin (not shown) may optionally be provided for bringing the alloy 17*c* into uniform contact with the entire inner surface of the cylindrical cooling device (45, 55).

By employing the device (40, 50) in place of the device 20*a*, the alloy may be forced-cooled while the alloy crystal structure is controlled to a desired state, and the space efficiency of the manufacturing system may be improved. Thus the cooling device 18 in the form of a container as shown in FIG. 1 may be replaced with an ordinary container, and the alloy 17*c* does not have to be introduced into the container in an inert gas atmosphere, so that the chamber 11 in which an inert gas atmosphere is established may accommodate only a series of components from the melting furnace 13 to the device (40, 50). Here, the components do not have to be accommodated in a single chamber 11, but each component may separately be accommodated in a chamber in which an inert gas atmosphere may be established, and the components may be connected with connecting tubes or the like. The device (40, 50) may optionally have, for example, a shield valve (not shown) provided in an introducing transition tube extending to the entry port (41*a*, 51*a*) for the alloy flakes 17*b*, so that the device (40, 50) may be shielded with the shield valve for establishing an inert gas atmosphere therein. In this case, the device (40, 50) does not have to be accommodated in a chamber in which an inert gas atmosphere may be established.

Further, when the device 50 is employed, the interior of the pipe 51-1 does not have to be maintained at the same temperature as that of the pipe 51-2, but may be at a different temperature.

EXAMPLES

The present invention will now be explained in more detail with reference to Examples, which are illustrative only and do not intend to limit the present invention.

Example 1

Alloy flakes were produced in the following process using the manufacturing system 10 shown in FIG. 1, wherein the device 20 was replaced with the device 50 shown in FIG. 5, and the cooling device 18 in the form of a container was replaced with a container having no cooling unit.

32.8 mass % neodymium, 1.02 mass % boron, 0.28 mass % aluminum, and the balance of iron were weighed out so that the total weight was 500 kg, and melted in the vacuum melting furnace 13. The resulting alloy melt was discharged at 1430° C., fed onto the water-cooled copper roll 17*a* via the tundish 14, and continuously solidified. The surface velocity of the roll 17*a* was 1.2 m/sec. The temperature of the free surface of the alloy flakes solidified on the roll 17*a* was measured with an infrared thermometer at the location where the alloy flakes were separated from the roll, and found to be 880° C. It took 20 minutes from the start to the end of discharge of the alloy melt. The alloy flakes were crashed into the alloy crushing plate 16 to become thin flakes of about 50 mm in diameter, and fell into the entry port 51*a* of the device 50. The falling alloy flakes, which had a surface temperature of not lower than 750° C., were introduced into the pipe 51-1 of the device 50, conveyed through the pipe 51-1 under such conditions as to be maintained at 750° C. for 5 minutes, then introduced into the pipe 51-2, conveyed through the pipe 51-2 under such conditions as to be maintained at 600° C. for 5 minutes, and conveyed into the pipe 55. The pipe 55 was water-cooled, so that the received alloy flakes were forced-cooled down to the room temperature, and placed in the container.

Figure 6:
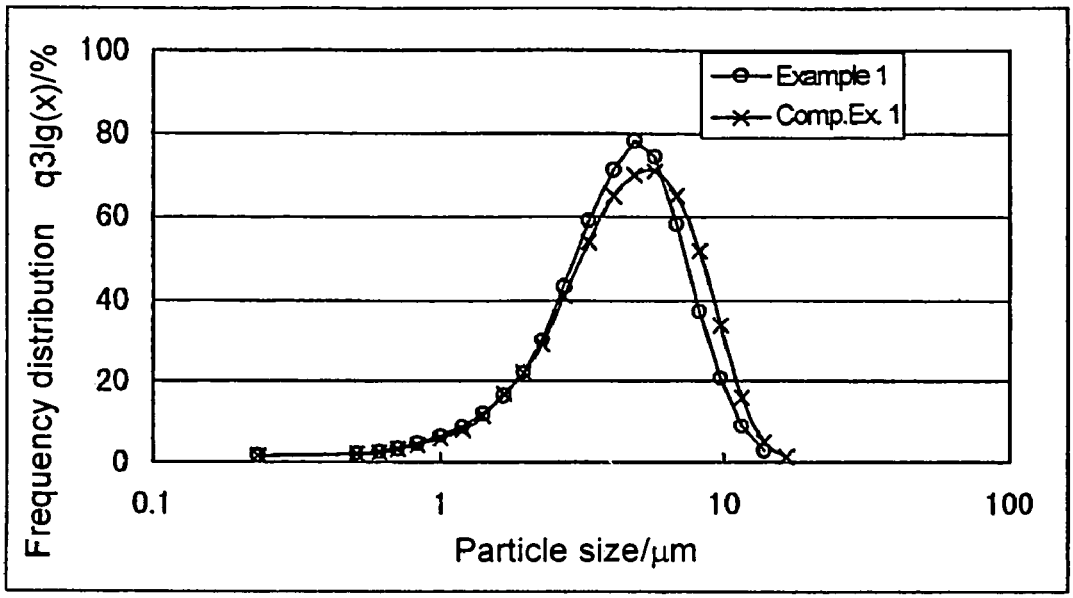
FIG. 6 is a graph showing the particle size distributions of the powders pulverized in a jet mill in Example 1 and Comparative Example 1.

Next, the obtained alloy flakes were subjected to hydrogenation and dehydrogenation, which are generally known as processes for producing magnets, and then pulverized in a compact jet mill at a pulverizing gas pressure of 7.0 kg/cm$^2$ and a material feed rate of 4 kg/hr. The average distances between the R-rich phases of the alloy flakes immediately after the commencement of casting, in the middle of the casting, and immediately before the completion of the casting, the average and the standard deviation of the distance between the R-rich phases of the alloy flakes taken as a sample at random from a casting lot, D50 of the powders pulverized in the jet mill, and the uniformity of the particle size distribution of the powders pulverized in the jet mill according to the Rosin-Rammler distribution are shown in Table 1. The particle size distribution of the powders pulverized in the jet mill is shown in FIG. 6.

Here, the distance between the R-rich phases was determined as follows. A photograph of a sectional structure of an alloy flake was taken under an optical microscope. Aline passing through the center of the cross section taken in the direction of the thickness of the flake was drawn generally in parallel to the face of the flake, and divided equally with line segments spaced from each other for a unit width. The number of the R-rich phases crossing each of the line segments spaced for a unit width was counted, and the length of the line segment was divided with the number of the R-richphases counted. The obtained value was taken as the distance between the R-rich phases. This measurement of the distance between the R-rich phases was made for 100 units or more. In the present case, a ×200 photograph of a sectional structure is taken, and along the center line of the cross section, the number of R-rich phases crossing the line segments at 1 cm (50 μm) intervals were counted at five points for each picture. This measurement was made for 20 alloy flakes to obtain a total of 100 data.

The uniformity of the powders pulverized in the jet mill was determined as follows. The alloy flakes were hydogen-decrepitated and pulverized in a jet mill into powders having an average particle size of 3 to 7 μm. The particle size distribution of the obtained alloy powders was measured with a laser diffraction particle size distribution analyzer, from which an accumulated particle size value (R(x)) for each particle size (x) was determined. A log of each particle size (lnx), and a log-log of an inverse number of the accumulated particle size value (ln(ln(1/R(x)))) were calculated. Plotting the values with ln(x) as the X-axis and (ln(ln(1/R(x)))) as the Y-axis resulted in a linear line, and the slope of this linear line indicated the uniformity in the Rosin-Rammler distribution. The characteristic size is the value of x when R(x)=0.368. A larger uniformity represents a sharper particle size distribution with a smaller variation in the alloy structure, and a smaller uniformity represents a broader particle size distribution with a larger variation in the alloy structure.

Comparative Example 1

The alloy flakes separated from the roll in Example 1 were collected in a container made of a highly heat-insulating material, without using the device 50. The alloy flakes, after all of them were collected, were kept in the container for 10 minutes. The temperature of the alloy flakes immediately after introduction into the container was 750° C., the temperature 3 minutes after the collection was 705° C., and the temperature 10 minutes after the collection was about 640° C. After kept for 10 minutes, the alloy flakes were introduced into a water-cooled container, and cooled to the room temperature.

The resulting alloy thin flakes were hydrogenated and pulverized into powders as in Example 1, and the obtained powders were subjected to the same measurements as in Example 1. The average distance between the R-rich phases of the alloy flakes immediately after the commencement of casting, in the middle of the casting, and immediately before the completion of the casting, the average and the standard deviation of the distance between the R-rich phases of the alloy flakes taken as a sample at random from a casting lot, D50 of the powders pulverized in the jet mill, and the uniformity of the particle size distribution of the powders pulverized in the jet mill according to the Rosin-Rammler distribution are shown in Table 1. The particle size distribution of the powders pulverized in the jet mill is shown in FIG. 6.

What is claimed is:

1. A manufacturing system for an alloy material containing rare earth metals comprising:

a melting furnace for melting a starting material alloy containing rare earth metals, solidifying means for continuously cooling and solidifying an alloy melt discharged from the melting furnace into alloy flakes, crystal structure controlling means for controlling a crystal structure of the alloy flakes into a desired state, and cooling means for cooling the alloy flakes, wherein at least said melting furnace, said solidifying means, said crystal structure controlling means, and said cooling means are operable in an inert gas atmosphere, said crystal structure controlling means further comprising a conveying device having a delivery space for continuously delivering the alloy flakes from the solidifying means to the cooling means, said conveying device having temperature regulating means for regulating the temperature of said delivery space to a desired temperature.

2. The manufacturing system of claim 1, wherein said conveying device has a rotatable pipe (A) defining said delivery space therein, and provided with a fin extending spirally along its inner surface at a particular angle, wherein said pipe (A) is provided with at least one of a heat insulating layer and a heating section as said temperature regulating means.

3. The manufacturing system of claim 2, wherein said conveying device comprises connected pipes consisting of plurality of said pipes (A) connected with each other, wherein each of said pipes (A) is provided with said temperature regulating means for controlling the temperature of each pipe (A) independently from others.

4. The manufacturing system of claim 2, wherein said conveying device comprises a multiple pipe consisting of a plurality of pipes (A) arranged coaxially, wherein each of said pipes (A) is provided with said temperature regulating means for controlling the temperature of each pipe (A) independently from others.

5. The manufacturing system of claim 1, wherein said cooling means comprises a container for containing alloy flakes discharged from the crystal structure controlling means, and a cooling medium feed unit for circulating a cooling medium through a hollow structure of walls of said container.

6. The manufacturing system of claim 4, wherein said cooling means comprises a rotatable cylindrical cooling device, wherein said cylindrical cooling device is arranged coaxially around said multiple pipe.

TABLE 1

| | Distance between R-rich phases (μm) | | | | | Particle size distribution of powders pulverized in jet mill | |
|---|---|---|---|---|---|---|---|
| | Immediately after casting | In the middle of casting | Immediately before completion | Random extraction | Random extraction Standard deviation | D50 (μm) | Uniformity |
| Example 1 | 5.27 | 4.93 | 5.41 | 5.18 | 1.2 | 5.46 | 2.22 |
| Comp. Ex. 1 | 6.35 | 5.39 | 4.68 | 5.58 | 2.5 | 5.89 | 2.11 |

7. The manufacturing system of claim 6, wherein said cylindrical cooling device has a plurality of fins on its inner surface.

8. The manufacturing system of claim 6, wherein said cylindrical cooling device has a cooling medium circulating means in a wall of the cylindrical cooling device.

9. The manufacturing system of claim 1, wherein said solidifying means comprises a cooling and solidifying device for cooling and solidifying the alloy melt into ribbons or flakes, and a tundish for guiding the alloy melt from the melting furnace to the cooling and solidifying device.

10. The manufacturing system of claim 9, wherein said solidifying means comprises a crushing section for crushing solidified alloy from the cooling and solidifying device.

* * * * *